US010351295B2

(12) United States Patent
Van Der Korput

(10) Patent No.: US 10,351,295 B2
(45) Date of Patent: Jul. 16, 2019

(54) DISPLAY CONTAINER

(71) Applicant: Schoeller Allibert GmbH, Schwerin (DE)

(72) Inventor: Maximus Gerardus Maria Van Der Korput, Zutphen (NL)

(73) Assignee: Schoeller Allibert GmbH (DE)

( * ) Notice: Subject to any disclaimer, the term of this patent is extended or adjusted under 35 U.S.C. 154(b) by 0 days.

(21) Appl. No.: 15/568,694

(22) PCT Filed: Apr. 13, 2016

(86) PCT No.: PCT/EP2016/058143
§ 371 (c)(1),
(2) Date: Oct. 23, 2017

(87) PCT Pub. No.: WO2016/169827
PCT Pub. Date: Oct. 27, 2016

(65) Prior Publication Data

US 2018/0155078 A1 Jun. 7, 2018

(30) Foreign Application Priority Data

Apr. 24, 2015 (DE) ..... 10 2015 106 332

(51) Int. Cl.
*B65D 6/18* (2006.01)
*B65D 19/18* (2006.01)
*B65D 25/00* (2006.01)

(52) U.S. Cl.
CPC ..... *B65D 11/1806* (2013.01); *B65D 19/18* (2013.01); *B65D 25/005* (2013.01);
(Continued)

(58) Field of Classification Search
CPC .... B65D 19/06; B65D 11/18; B65D 11/1846; B65D 11/1853; B65D 19/18; B65D 11/1806; B65D 25/005; E05D 11/06
(Continued)

(56) References Cited

U.S. PATENT DOCUMENTS 4,181,236 A * 1/1980 Prodel ..... B65D 11/1846 220/4.29
5,829,617 A * 11/1998 Umiker ..... B65D 1/225 220/6
(Continued)

FOREIGN PATENT DOCUMENTS

DE 4143023 C1 5/1993
DE 9401707 U1 4/1994
(Continued)

OTHER PUBLICATIONS

European Search Report for European Application No. 17 207 304.1, dated Mar. 15, 2018, including English translation, 12 pages.
(Continued)

*Primary Examiner* — Anthony D Stashick
*Assistant Examiner* — Lauren E Kmet
(74) *Attorney, Agent, or Firm* — RatnerPrestia

(57) ABSTRACT

A container for transporting and storing or presenting goods includes a bottom, a first side wall segment articulated to the bottom and which can be folded about a folding axis parallel to the bottom between a first folding position and a second folding position, and at least one second side wall segment, which is articulated to a side edge of the first side wall segment and which can be pivoted about a pivoting axis perpendicular to the bottom between a first pivoting position pivoted laterally away from the first side wall segment and a second pivoting position. The first side wall segment and/or the second side wall segment have at least one angled
(Continued)

side border segment on the side edges facing each other and the two side wall segments are articulated to each other.

13 Claims, 5 Drawing Sheets

(52) U.S. Cl.
CPC ..... *B65D 2519/00034* (2013.01); *B65D 2519/00069* (2013.01); *B65D 2519/00174* (2013.01); *B65D 2519/00273* (2013.01); *B65D 2519/00641* (2013.01); *B65D 2519/00925* (2013.01)

(58) Field of Classification Search
USPC ..... 220/4.28, 4.29, 666, 6, 736; 206/736, 206/766, 600

See application file for complete search history.

(56) References Cited

U.S. PATENT DOCUMENTS

| | | | |
|---|---|---|---|
| 6,305,566 | B1 | 10/2001 | Pigott et al. |
| 2005/0230391 | A1 | 10/2005 | Hadar |

FOREIGN PATENT DOCUMENTS

| | | | | |
|---|---|---|---|---|
| DE | 19601689 | A1 | 7/1997 | |
| DE | 102007011858 | A1 | 9/2008 | |
| WO | 2006067774 | A2 | 6/2006 | |
| WO | 2011048259 | A1 | 4/2011 | |
| WO | WO 2011048259 | A1 * | 4/2011 | ..... B65D 11/1833 |

OTHER PUBLICATIONS

International Search Report and Written Opinion for International Application No. PCT/EP2016/058143, dated Jun. 16, 2016—14 Pages.

* cited by examiner

DISPLAY CONTAINER

RELATED APPLICATION(S)

This application is the United States national phase entry of International Application No. PCT/EP2016/058143, filed Apr. 13, 2016, which claims the benefit of priority of German Application No. DE 10 2015 106 332.8, filed Apr. 24, 2015. The contents of International Application No. PCT/EP2016/058143 and German Application No. DE 10 2015 106 332.8 are incorporated by reference herein in their entireties.

FIELD

The present invention relates to a container for transporting and storing goods, and especially to a display container for presenting goods.

BACKGROUND

Usually goods are delivered in transport containers or boxes to retailers and are rearranged there from the transport container onto sales shelves. Instead of removing the goods from the transport containers and rearranging them onto sales shelves and thus presenting them to customers, in the past few years people have increasingly turned, for reasons of costs and space, to present the goods in entire compounds or stacks of goods or even in the transport boxes to the customer. Since a plurality of goods is sold in bags, cardboard packages etc., which are susceptible to being damaged during transport, the transport boxes have to protect the delivered goods from outside preferably from all sides and completely against any application of force. Furthermore, said boxes are only allowed to have a low dead weight and in the empty state should be adapted to be compacted so that they can be intermediately stored or returned in a space-saving manner. For this purpose, usually foldable plastic containers are used. Said containers are only partially suited for presenting goods for sale, as the side walls protecting the goods from all sides during transport are also concealing the goods.

When, as suggested in the documents U.S. Pat. No. 6,305,566 B1 and WO 2011/048259 A1, a side wall is omitted for the purpose of presentation, there is a risk that during transport the goods may fall out or may be damaged exactly on the side of the omitted side wall. By omitting a side wall, especially in a foldable container another problem arises. In a container having three inwardly foldable side walls, the side walls at the (two) corner edges are interconnected merely via stop catches or other latching elements. Thus, the remaining three side walls are lacking sufficient stability, especially in the area of the two remaining corner edges.

SUMMARY

Against this background, the present invention is based on the object to provide a container which is equally suited for the transport and the presentation of goods and which solves the problems described above in connection with prior art in a simple manner.

The container according to the invention is suited for transporting and storing goods. Especially, it may be a display container for presenting goods. Said container according to the invention includes a base, a first side wall section or a first (long) side wall which is articulated to the base and a second side wall section or a second (short) side wall which is not articulated to the base but is articulated to the first side wall section or the first side wall. In this way, the second side wall section (the second side wall) can be pivoted laterally (about a vertical axis) to and from the first side wall section (the first side wall) and the first side wall section (the first side wall) can be folded to and away from the base together with the second side wall section (the second side wall). On the side edges facing each other the first side wall section and/or the second side wall section (the first side wall and the second side wall) have at least one angled side rim or connecting portion and the two side wall sections (the two side walls) are articulated to each other in such a way that the at least one angled side rim portion of at least one of the two side wall sections lies against or is adjacent to the other side wall section in a planar manner at least in the first pivoting position.

In this way, the two side wall sections are connected to each other not only by their articulation but also via a pair of contact surfaces enlarged by the angled side rim portion. The full-surface contact of the angled side rim portion of the one side wall section with the other side wall section defines sort of a limit stop as well as a predetermined (especially vertical) alignment of the one side wall section relative to the other side wall section. It is achieved in this manner that, despite one (long) side wall is missing, sufficient stability of the two (short) side walls is ensured for the container by means of the one (long) side wall. Due to the enlarged surface contact between the side wall sections articulated to each other, the pivoting side walls are more resistant to bending and/or torsional moments.

In the container according to the invention, the base may be substantially rectangular, the first side wall section may be foldable about a horizontal or base-parallel folding axis, viz. between a first substantially vertically aligned folding position and a second inwardly folded and substantially horizontal folding position. The second side wall section may be adapted to be pivoted about a vertical or base-vertical pivoting axis, viz. between a first pivoting position in which the two side wall sections substantially form a right angle with each other and a second pivoting position in which the second side wall section is pivoted toward the first side wall section. The one or both angular profiles of the side rim portions of the two side wall sections are preferably equally right-angled. The first side wall section may be part of a side wall, especially a long side wall or back wall, or may form the entire side wall. The second side wall section may be part of a side wall adjacent thereto, especially a short side wall, or may form the entire side wall. Furthermore, on each of the two sides of the first side wall section a second side wall section (substantially of equal configuration) may be provided. In this case, the first side wall section and the two second side wall sections may form a circumferential U-shaped side wall of the container. The two second side wall sections then form sort of inwardly pivoting wing-type walls or doors. The respective pairs of angular profiles in the side rim portions impart still sufficient stability also to the free ends of the two second side walls.

According to one aspect of the invention, each of the first side wall section and the second side wall section includes the at least one angled side rim or connecting portion so that the angled side rim portions are nested or encompass each other and form one or more angled pairs of contact surfaces at least in the outwardly pivoted (first) pivoting position in which the container is ready for use.

In this way, the two side wall sections are connected to each other not only by their articulation but also via a positive contact connection. Thus, the side edges of the two side wall sections are not arranged end-to-end but include overlapping or encompassing angular profiles which are adjacent to each other or nested in a planar manner. In this manner, the container is achieved to provide sufficient stability of the remaining walls despite a missing (long) side wall.

Since the angled side rim portions are overlapping, the corner areas are reinforced and thus are capable of resisting higher impact loads. Due to the stabilization by the pair of angular profiles, also different requirements to the articulation are resulting so that the latter can be designed more simply, as it does not have to solely absorb the impact and bending forces acting on the container.

In accordance with one aspect of the invention, the pivoting axis may be located inside the container corner defined by the two angled side rim portions or, when viewed from said corner, may be arranged inwardly offset on either of the two side wall sections. This enables the required degree of freedom for swiveling the angular (L) profiles toward each other.

In accordance with one aspect, the pivoting axis may extend through the free end of the L-shaped or rectangular side rim portion of the second side wall section and may extend to be inwardly offset in the area of the first side wall section. In this case, the first side wall may encompass the second side wall.

In accordance with one aspect, the angled side rim portion(s) of the second side wall section may be provided in the first pivoting position in full-surface contact inside the angled side rim portion(s) of the first side wall section. Alternatively, they may be arranged alternately inside and outside the angled side rim portions of the first side wall section.

In accordance with one aspect, the angled side rim portions may include, in the area of the contact faces, designs complementary to each other, such as projections and recesses or ribs and grooves, which engage in each other at least in the first pivoting position. The stability is further increased by the positively engaging outer and inner contours of the angled side rim portions. This may ensure the fact that the two side wall sections cannot be moved vertically relative to each other. In addition, already the mere designs entail the reinforcement of each of the respective angled rim portions so that they cannot break even in the case of higher loads.

According to one embodiment, the second side wall section may have, at the edge facing the base, one or more designs which in the first pivoting position interact with one or more designs configured complementarily at the one corresponding base rim portion of the base so as to delimit the pivoting area of the second side wall section, for example, to the outside and/or to achieve a releasable latching between the second side wall section and the base. By interaction of said base-side designs, stabilization of the second side wall section is enabled in the first swivel (pivoting) position. Snap lugs or other detent means may help to prevent the second side wall section from pivoting inwardly on its own or in the case of minor impacts. In any case, said designs prevent the second side wall section in addition to the L-profile in the vertical edge from being pivoted outwardly, e.g. by reason of goods shifting during transport. Furthermore, the designs may be such that they permit form closure (undercut) not only to the side but also in the vertical direction. For this purpose, the designs may be T-shaped so as to engage in appropriately undercut recesses of the other container element.

In accordance with one aspect of the invention, the angled side rim portion of the first and/or second side wall section may include recesses which are adapted to reach through the designs formed at the base rim portion, when the first side wall section is folded with the second side wall section provided in the second pivoting position toward the base into the second folding position. This ensures that the first side wall can be folded completely inwardly together with the second side wall and do not stand out from the designs on the base rim portion.

In accordance with one aspect of the invention, the angled side rim portions of the second side wall section in the second folding position may be located inside the base rim portion and the angled side rim portions of the first side wall section may be located outside the base rim portion. By receiving the base rim between the two side rim portions, the height of the folded container may be further minimized. Furthermore, the side wall sections are virtually caught by the base rim portion so that they cannot rattle or hit against each other e.g. during transport or cannot twist in the case of a respective load during stacking.

In accordance with one aspect, the base rim portion may have one or more recesses, preferably on the outside, for receiving the angled side rim portions of the first side wall section in a flush manner in the second folding position. In this way, also the play of the side wall sections can be minimized in the folded state. Moreover, this constructional measure equally has an effect on the overall height of the folded container.

In accordance with one aspect of the invention, the second side wall section may have, at the other opposite side rim portion, an inwardly, especially also upwardly, open vertical groove serving for receiving a side wall insert. In this way, the container closed on three sides by the side wall sections can be closed on the fourth side by means of a vertical slide element, e.g. a thin plastic plate, or by a cardboard box or by a retractable sliding grid or the like. The side wall insert additionally prevents the two second side wall sections from being pivoted inwardly.

In accordance with one aspect of the invention, at the groove itself or in the area of the groove detent means may be provided for releasably locking the side wall insert at one or more predetermined (height) positions.

In accordance with one aspect of the invention, the base on the side opposed to the side wall section may include a base rim portion having a holding fixture for a side wall insert, e.g. in the form of a vertically movable side wall element, folding grid or of a substitute wall. In this manner, the side wall insert can be received and secured not only by the two grooves formed in the two second side wall inserts but also in a groove provided in the base.

BRIEF DESCRIPTION OF THE DRAWING FIGURES

Further advantages will be evident from the following description of a preferred embodiment by way of enclosed drawings, of which:

DETAILED DESCRIPTION

Figure 1:
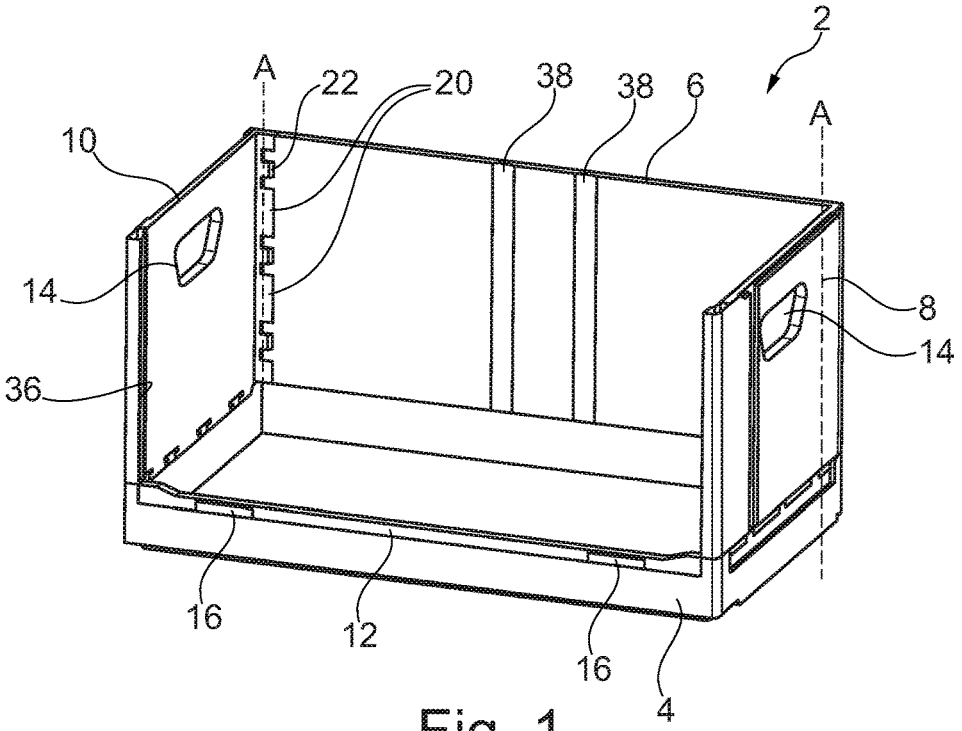
FIG. 1 shows a perspective view of a container according to a first embodiment of the invention in the completely erected condition.

FIG. 1 illustrates a perspective view of a container 2 suited for transporting and storing, however especially for presenting goods. The container 2 is preferably made from plastic. The container 2 includes a substantially rectangular base 4 which is trough-shaped and, resp., is recessed in the center and, resp., on the sides has somewhat elevated rims. The container 2 further includes a long side wall or back wall 6 (first side wall section) and two adjacent short side walls 8 and 10 (second side wall sections). At the second long side or front wall side instead of a fixed side wall a vertically movable folding grid 12 is provided which is shown completely lowered in FIG. 1. Thus, in the position shown in FIG. 1, the container 2 can be loaded and unloaded very easily via the front wall side, while the folding grid 12 can be pulled upwards and thus extended for the purpose of transport locking. In the position shown in FIG. 1, the container 2 is also perfectly suited for presenting goods.

Figure 2:
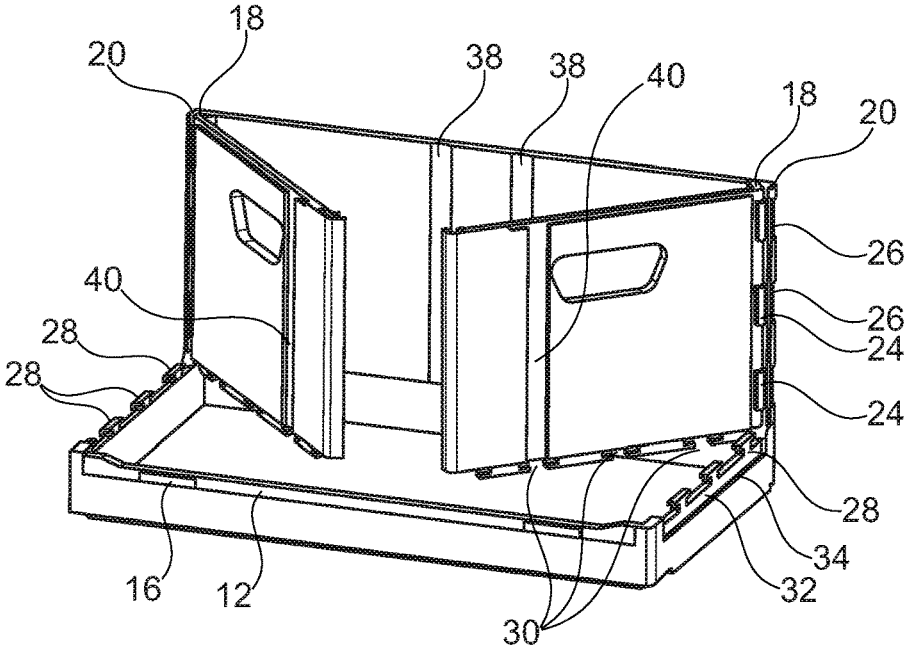
FIG. 2 shows the container according to the first embodiment of the invention with two partly inwardly pivoted side walls.
Figure 3:
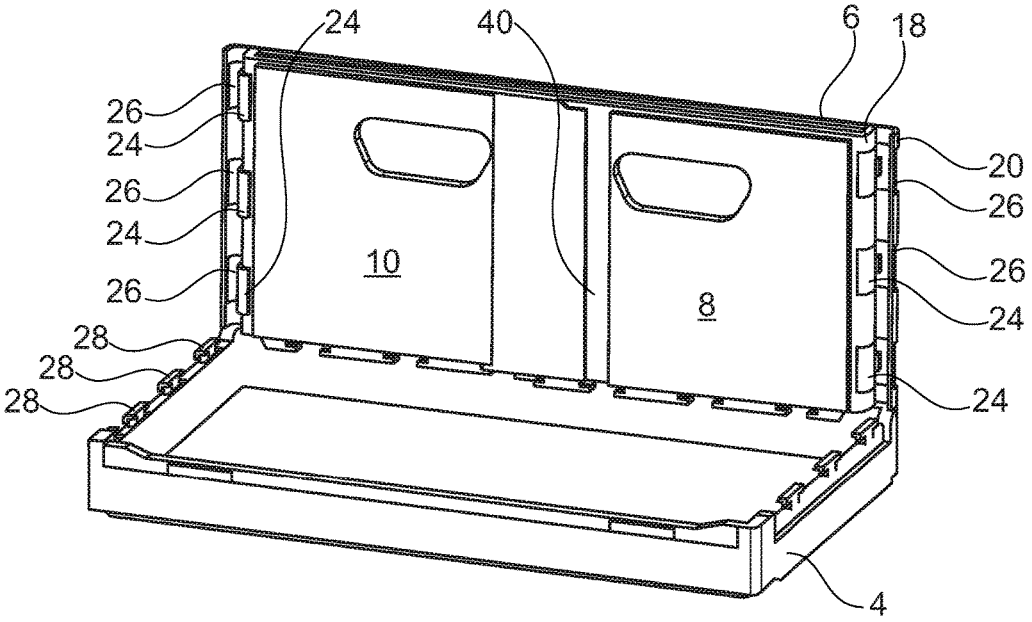
FIG. 3 shows the container according to the first embodiment of the invention with two completely inwardly pivoted side walls.
Figure 4:
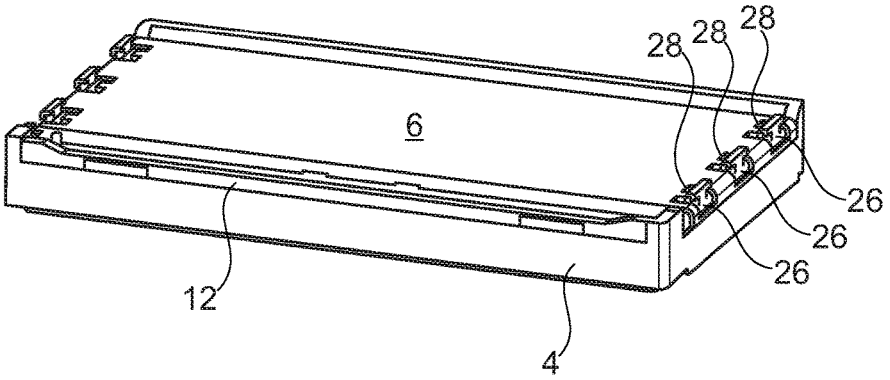
FIG. 4 shows the container according to the first embodiment of the invention with the back wall being folded inwardly together with two inwardly pivoted side walls.

The back wall 6 is articulated to the base 4, while the two side walls 8 and 10 are articulated to the back wall 6. In this way, each of the side walls 8 and 10 can be swiveled/pivoted inwardly, as shown in FIG. 2 (about a vertical pivoting axis) so as to be finally pivoted, in the completely inwardly pivoted position (second pivoting position) (cf. FIG. 3), completely and superimposed toward the back wall 6. Subsequently, as illustrated in FIG. 4, the back wall 6 can be folded together with the two inwardly pivoted side walls 8 and 10 (about a horizontal folding axis) toward the base and, resp., inwardly. It is further evident from FIG. 1 that the two short side walls 8 and 10 have grip openings 14 for lifting the container 2. The folding grid 12 includes two recesses or projections 16 so that it can be pulled upwards from the position shown in FIG. 1.

Each of the side walls 8 and 10 is connected to the back wall 6 about a vertical axis A to be pivoting by approx. 90° via a joint. From FIGS. 1 to 3 it is further evident that both side rim portions 18 of the side walls 8 and 10 facing the back wall 6 as well as side rim portions 20 of the back wall 6 facing the side walls 8 and 10 are formed to be bent in L shape or at right angles or include a plurality of such vertically spaced L-shaped portions which are flatly nested in the completely outwardly pivoted position of the side walls 8 and 10 shown in FIG. 1. The L-shaped rim portion 20 of the back wall 6 thus encompasses the respective L-shaped rim portion 18 of the side walls 8 and 10. The vertical pivoting axis A extends through the free end of the L-shaped rim portion 18 of the side wall 8 and, resp., 10 and through the back wall 6 in a portion that is offset somewhat inwardly or toward the center of the back wall 6 relative to the rim portion 20 of the back wall 6 so as to allow the L-shaped side rim portions of the side walls 8 and 10 to pivot.

The side walls 8 and 10 are connected to each other via plural vertically spread joint portions 22, e.g. by means of releasable plug joints. The L-shaped rim portion 18 of the side wall 8 and, resp., 10 further includes on its outside plural projections 24 spaced apart from each other in the vertical direction which, when the side wall 8 and, resp., 10 is outwardly pivoted, engage in recesses 26 appropriately formed in the side rim portions 20 of the back wall 6 so that the projections 24 complete the recesses 26 when the side wall 8 and, resp., 10 is completely outwardly pivoted, i.e. by 90° relative to the back wall 6.

The pivoting range of the side wall 8 and, resp., 10 is limited, on the one hand, to a maximum of 90° by interaction of the L-shaped rim portions 18 and 20, but on the other hand by vertically projecting stops 28 formed in T shape at the respective base edge (base rim portion 32) which stops engage in corresponding T-shaped recesses 30 formed at the lower edge of the side wall 8 and, resp., 10. The outward movement of the side wall 8 and, resp., 10 is limited by the interaction of the stops 28 and the recesses 30. Further, the stops and/or recesses include appropriate detent means so as to lock the side wall 8 and, resp., 10 in the outwardly pivoted position (FIG. 1) with the base 4. Due to the undercut recesses 30, the side wall 8 and, resp., 10 is secured in the outwardly pivoted position via the stops 28 also in the vertical direction.

When the folding grid 12 is pulled upwards, said grid, too, prevents the side walls 8 and 10 from pivoting inwardly. When the side wall 8 and, resp., 10 is pivoted completely inwardly (cf. FIG. 3), the L-shaped leg of the rim portion 18 of the side wall and the L-shaped leg of the side rim portion 20 of the back wall 6 are somewhat spaced apart from each other, namely so far that, when the back wall 6 is brought from the outwardly folded position shown in FIG. 3 to the inwardly folded position shown in FIG. 4, the two L-shaped rim portions 18 and 20 encompass the rim 32 of the base 4 on both sides, with the stops 28 formed at the base rim 32 passing through the recesses 26 in the side rim portion 20 of the back wall 6. In this way, the back wall 6 can be folded together with the two side walls 8 and 10 into the trough-shaped base 4 in a space-saving manner.

In the completely folded position as shown in FIG. 4, the two side walls 8 and 10 are received in the trough-shaped interior of the base 4 and the back wall 6 encompasses the two opposite short base rim portions 32. For receiving the L-shaped rim portions 20 of the back wall 6 in a flush manner, a recess 34 which is completed by the L-shaped rim portion 20 of the back wall 6 in the folded position is further provided in the base rim portion 32 (cf. FIG. 4).

For vertically guiding the folding grid 12, each of the two side walls 8 and 10 includes on the side edge facing the folding grid 12 vertical grooves 36 which are open to the inside and are open downwards (to the base). The folding grid 12 may be pulled vertically upwards along said grooves 36 and can be locked via detent means 48' (cf. FIG. 10) in the completely extended position, i.e. when the folding grid reaches the upper edge of the adjacent side walls 8 and 10, as will be described later in detail.

As is further visible from FIGS. 1 and 2, the back wall 6 has two recesses 38 extending in the vertical direction and being equally spaced from the center of the wall on both sides, said recesses serving for receiving the grooves 36 protruding somewhat from the inner side wall surface, when the side wall 8 and, resp., 10 is pivoted inwardly toward the back wall 6. As the two side walls 8 and 10 together are wider than the back wall 6, they are necessarily overlapping when they are pivoted toward the back wall 6. Against this background, the left-hand recess 38 in the back wall 6 as shown in FIG. 1 is provided for the groove 36 of the right-hand side wall 8, when the latter is pivoted inwardly first, and the right-hand recess 38 as shown in FIG. 1 is provided for the groove 36 of the left-hand side wall 10, when the latter is pivoted inwardly before the other side wall 8.

The container 2 according to the invention thus permits pivoting the two side walls 8 and 10 inwardly in any order without entailing any drawback. For the same reason, the two side walls 8 and 10 in turn have recesses 40 extending vertically on their outside which equally serve for receiving the groove 36 of the respective other side wall 8 and, resp., 10 which is pivoted inwardly in the second place. This enables the side walls 8 and 10 to be folded or pivoted inwardly in a space-saving manner without the user having to observe any predetermined pivoting order.

Figure 5:
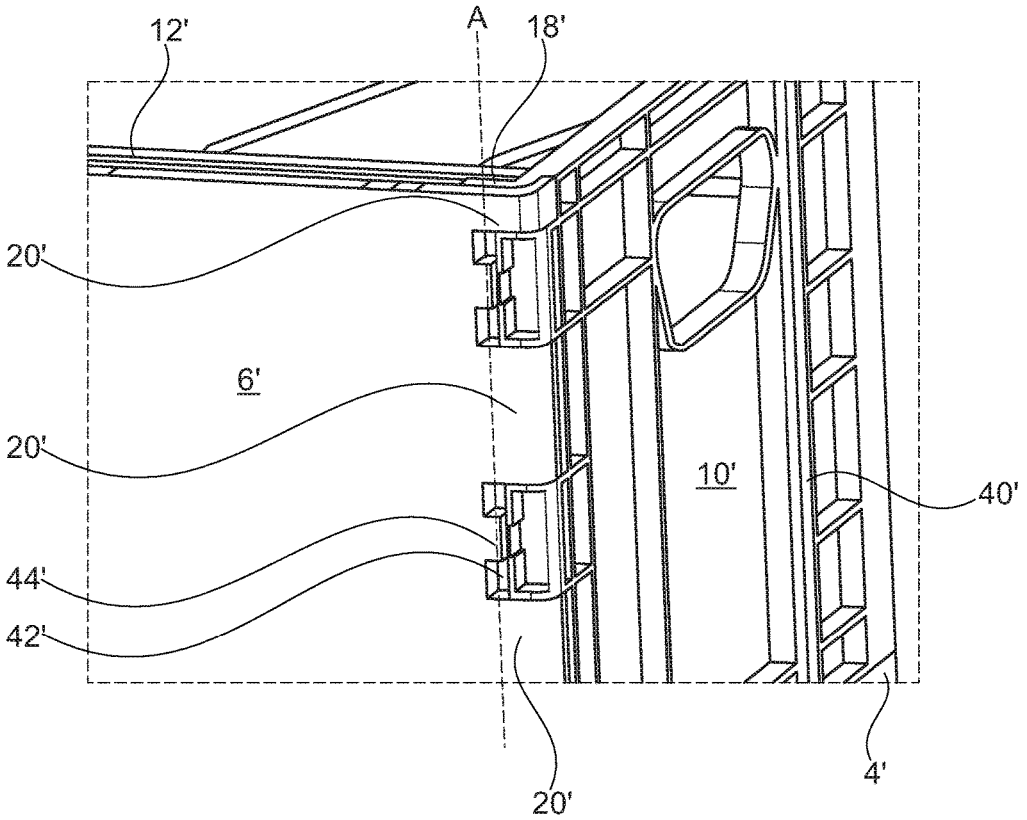
FIG. 5 shows a detailed view of the pivot joint according to a second embodiment from the rear.
Figure 6:
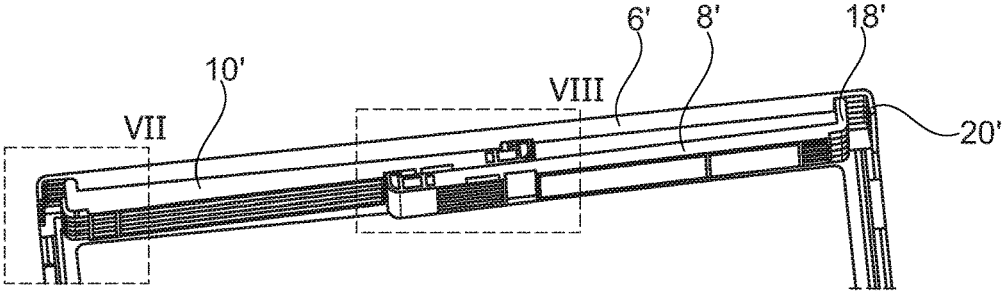
FIG. 6 shows a perspective partial top view of the back wall comprising two inwardly pivoted side walls according to the second embodiment of the invention.

FIGS. 5 to 10 describe a second embodiment of the invention, the latter differing from the first embodiment by single aspects only, therefore it is not intended to repeat the entire description of the first embodiment with respect to the second embodiment. FIG. 5 illustrates a perspective rear view of the container 2', wherein it is evident also here that the side wall 10 and, resp., 8 includes L-shaped rim portions 18' and the back wall 6 includes L-shaped rim portions 20'. As is visible from FIG. 5, the L-shaped rim portions 18' of the side wall 10' include joint pins 42' adapted to be clipped into corresponding joint holding fixtures 44'. In the second embodiment, too, the L-shaped rim portions 20' of the back wall 6' encompass the rim portions 18' of the side wall 10' and, resp., 8'. In the background of FIG. 5, furthermore the raised and unfolded folding grid 12' which is adapted to prevent objects from falling out of the container to the front is visible at the container front side. FIG. 6 illustrates a perspective partial top view including the back wall 6' and the two inwardly pivoted side walls 8' and 10', wherein the left-hand side wall 10' has been pivoted inwardly before the right-hand side wall 8' and the left-hand side wall 10' is adjacent to the inner surface of the back wall 6' and the right-hand side wall 8' contacts the left-hand side wall 10'.

It is further evident that the second embodiment differs also by the surface design of the respective walls 6, 8 and 10, i.e. that they exhibit (substantially) single-walled side walls including reinforcing ribs instead of double-walled side walls having smooth surfaces.

Figure 7:
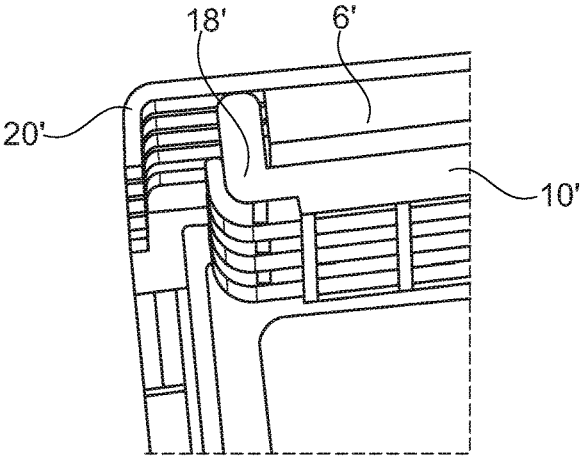
FIG. 7 shows the detailed view VII from FIG. 6.

FIG. 7 illustrates a detailed view VII from FIG. 6, namely the interaction of the L-shaped rim portions 18' and 20' of the back wall 6' and, resp., side wall 10'. As is especially evident from FIG. 7, the joint axis extends through the free end of the L-shaped rim portion 18' of the side wall 10' and through a portion in the back wall 6' which is moved inwardly by the leg of the L-shaped rim portion 18' so as to provide the appropriate pivoting space for the L-shaped rim portion 18'. The surfaces of the two L-shaped rim portions 18' and 20' facing each other and, resp., the inner surface of the rim portion 20' of the back wall 6' and the outer surface of the rim portion 18' of the side wall 10' are provided with transverse grooves and ribs (in parallel to the upper edge of the back wall) which alternately engage in each other in the vertical direction. This design does not only help to stiffen or reinforce the L-shaped rim portions 18' and 20' but also helps to obtain form closure between the side wall 10' and, resp., 8' and the back wall 6', thus relieving the joints.

Figure 8:
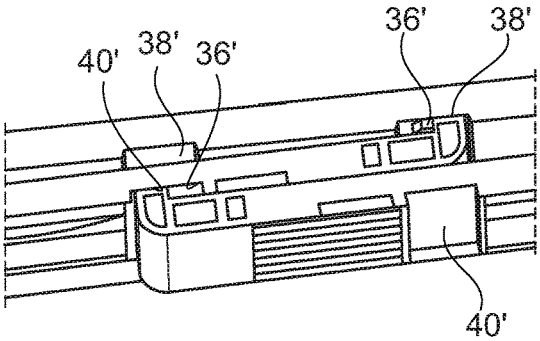
FIG. 8 shows the detailed view VIII from FIG. 6.

In FIG. 8 engagement of the grooves 36' on the inside of the two side walls 8' and 10' in the respective recesses 38', 40' on the back wall 6' and, resp., on the outside of the side wall 10' is visible. The inverse image is resulting when the pivoting order is changed. In this respect, the second embodiment is not different from the first embodiment, therefore any further explanations are omitted in this context.

Figure 9:
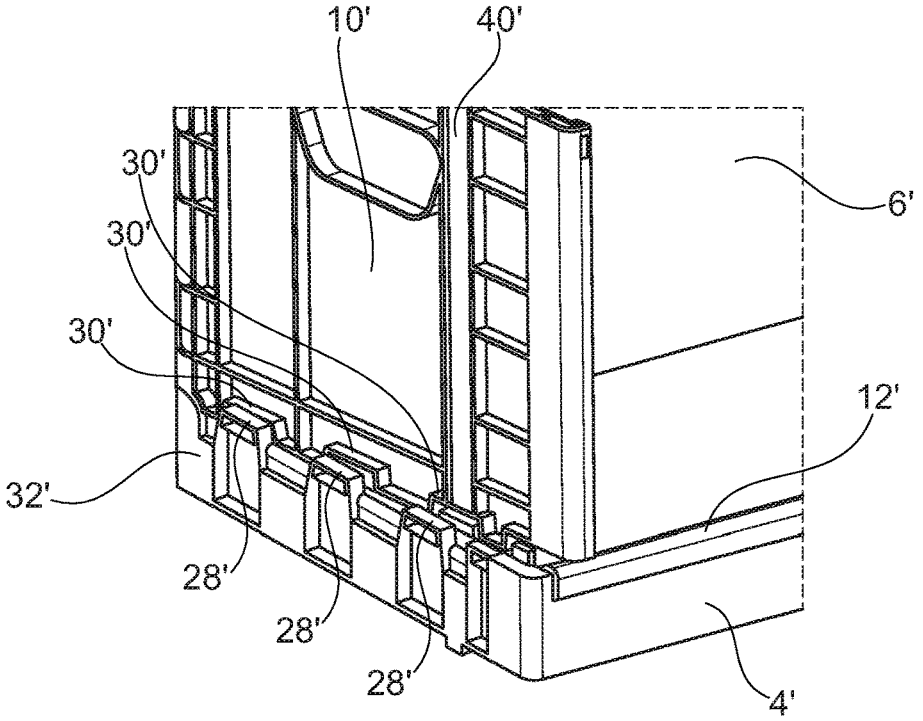
FIG. 9 shows a perspective view of a side wall according to the second embodiment of the invention in a condition immediately before the completely swung-open position.

FIG. 9 illustrates the side wall 10' directly before the maximum pivoting position is reached. In contrast to the first embodiment, the stops 28' formed at the base rim 32' are not in the form of T-shaped stops but in the form of almost rectangular lugs 28', with corresponding projections 30' formed at the outer wall surface of the side wall 10' and, resp., 8' in the lower edge area penetrating the recesses of said lugs and thus enabling the side wall 10' to be vertically secured to the base 4'.

Figure 10:
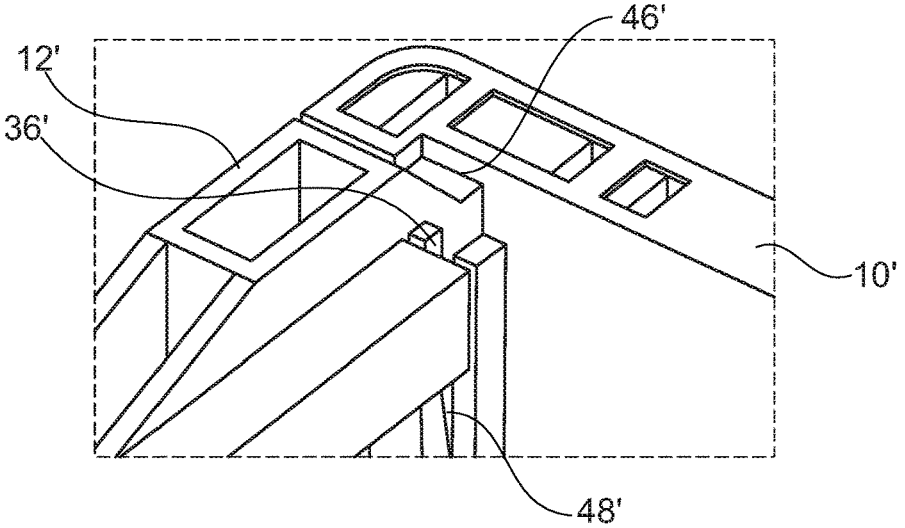
FIG. 10 shows a detailed partial top view of a corner area between a side wall and a folding grid moved upwards at the container front side according to the second embodiment of the invention.

FIG. 10 illustrates the front corner area of the side wall 10' with the completely raised folding grid 12'. As is evident from FIG. 10, the groove 36' is not open toward the top so that the upper groove end 46' forms an upper stop for the folding grid. It is further evident from FIG. 10 that at the groove 46' a detent ramp 48' is formed which, when it has been overcome, enables a vertical captive fastening of the folding grid 12' in the position shown in FIG. 10. In order to overcome the detent ramp 48' a particular force has to be applied from above to the folding grid 12', thus causing the folding grid 12' and/or the side wall 10' to move to the side and to release the folding grid 12'.

By way of the embodiments a container was described in which the side walls adjacent and, resp., articulated to each other include respective angled side rim portions forming overlapping angular profiles. The articulation between the side walls may be increased already when only one side wall section includes an angled side rim portion which in the outwardly pivoted position (position of use) lies flat (with its outer or inner side) against the other side wall section.

The invention claimed is:

1. A display container for the storage and transportation or presentation of goods, the container comprising:

a rectangular base having a base rim portion;

a longer first side wall having opposing side rim portions; and two shorter second side walls, wherein the first side wall is pivotally connected with the base such that it can pivot around a horizontal axis between a first folding position, in which the first side wall is substantially upright, and a second folding position, in which the first side wall is collapsed inwardly onto the base into a substantially horizontal or base parallel orientation; and the second side walls are hingedly connected with the opposing side rim portions of the first side wall and each movable between a first swivel position, in which the respective second side wall is swung away from the first side wall in a lateral direction, and a second swivel position, in which the respective second side wall is swung towards the first side wall, wherein, in order to collapse the container, the second side walls are swung towards the first side wall into the second swivel position such that they are substantially parallel to the first side wall and subsequently the first side wall and the second side walls are collapsed around the horizontal axis into the substantially horizontal or base parallel orientation together, and wherein, the two second side walls each comprise an L-shaped side rim portion at their respective side rims facing the first side wall, and the side rim portions of the first side wall and the second side walls are jointed such that the L-shaped side rim portions of the second side walls lie flat against the opposing side rim portions of the first sidewall in the first swivel position, forming limit stops that define right angles between the first side wall and the second side walls.

2. The container according to claim 1, wherein lower edge sections of the second side walls, which face the base rim portion, and corresponding upper sections of the base rim portion, are shaped complementarily such that, when the second side walls are moved into the first swivel position, the complementary sections of the second side walls and the base rim portion form limit stops through form-locking engagement.

3. The container according to claim 2, wherein the lower edge sections of the second side walls each comprise at least one protrusion which is formed complementarily to at least one recess formed in the upper section of the base rim portion and which inserts therein, when the second side walls are moved into the first swivel position.

4. The container according to claim 2, wherein the lower edge section of each second side wall and the complementary upper section of the base rim portion form a latching engagement with one another, when each second side wall is moved into the first swivel position.

5. The container according to claim 1, wherein the two vertical swivel axes extend through ends of the respective L-shaped side rim portions of the second side walls that are conjoined with the first wall.

6. The container according to claim 1, wherein the second side walls include, at their respective other opposite side rim portion that is not conjoined with the first sidewall, an inwardly vertical groove for receiving a side wall insert.

7. The container according to claim 6, wherein engaging means for releasably locking the side wall insert at one or more predetermined positions are provided at the groove itself or in the area of the groove.

8. The container according to claim 1, wherein the base rim portion is located on the side opposite to the first side wall section, the base rim portion comprising a holding fixture for a side wall insert in the form of a vertically movable side wall element, folding grid or a substitute wall.

9. The container according to claim 1, wherein the first side wall includes on its surface facing an inner side of the container one or more recesses for receiving projections correspondingly formed on the surface facing the inner side of the container of the second side wall in the second swivel position.

10. The container according to claim 1, wherein the second side walls are overlapping in the second swivel position.

11. The container according to claim 10, wherein each second side wall includes at its surface facing an outer side of the container one or more recesses for receiving projections correspondingly formed on the surface facing the inner side of the container of the respective other second side wall in the second swivel position.

12. A container for the storage, transportation and presentation of goods comprising:

a rectangular base;

a first side wall having a first side rim portion; and at least one second side wall having a second side rim portion, the first side wall being pivotally connected with the base such that it can pivot around a horizontal axis between a first folding position, in which the first side wall is substantially upright, and a second folding position, in which the first side wall is collapsed inwardly onto the base into a substantially horizontal or base parallel orientation, and the at least one second side wall being hingedly connected with the first side rim portion of the first side wall and movable between a first swivel position, in which the at least one second side wall is swung away from the first side wall in a lateral direction, and a second swivel position, in which the at least one second side wall is swung towards the first side wall, the first side rim portion of the first side wall and/or the second side rim portion of the at least one second side wall being an L-shaped side rim portion, the first side rim portion of the first side wall and the second side rim portion of the at least one second side wall being jointed such that the L-shaped side rim portion of the first side wall and/or the at least one second side wall lies flat against the other of the first side wall and the at least one second side wall, at least in the first swivel position, thereby forming a limit stop, which defines a right angle between the first side wall and the at least one second side wall, a lower edge section of the at least one second side wall, which faces the base rim portion, and an upper section of the base rim portion being shaped complementarily such that, when the at least one second side wall is moved into the first swivel position, the complementary sections of the at least one second side wall and the base rim portion form a limit stop, and the lower edge section of the at least one second side wall and the complementary upper section of the base rim portion form a snap-fit engagement with one another, when the at least one second side wall is moved into the first swivel position, in order to prevent the at least one second side wall from pivoting inwardly.

13. A container for the storage, transportation and presentation of goods comprising:

a rectangular base;

a first side wall; and at least one second side wall, the first side wall being pivotally connected with the base such that the first side wall can pivot around a horizontal axis between a first folding position, in which the first side wall is substantially upright, and a second folding position, in which the first side wall is collapsed inwardly onto the base into a substantially horizontal or base parallel orientation, the at least one second side wall being hingedly connected with a side rim portion of the first side wall and movable between a first swivel position, in which the at least one second side wall is swung away from the first side wall in a lateral direction, and a second swivel position, in which the at least one second side wall is swung towards the first side wall, the first side wall and the at least one second side wall each comprising an L-shaped side rim portion at their facing side rims, the L-shaped side rim portions being jointed such that the L-shaped side rim portions lie flat against each other in the first swivel position, thereby forming a limit stop, which defines a right angle between the first side wall and the at least one second side wall.

* * * * *